US007201273B2

(12) United States Patent
Chen et al.

(10) Patent No.: US 7,201,273 B2
(45) Date of Patent: Apr. 10, 2007

(54) AIR PACKING BAG HAVING FILM-TYPE CHECK VALVES

(75) Inventors: Cheng-Yung Chen, Taipei (TW); Tai-Hua Chen, Taipei (TW)

(73) Assignee: Camry Packing Industrial Limited, Sindian (TW)

( * ) Notice: Subject to any disclaimer, the term of this patent is extended or adjusted under 35 U.S.C. 154(b) by 0 days.

(21) Appl. No.: 10/828,312

(22) Filed: Apr. 21, 2004

(65) Prior Publication Data

US 2005/0189257 A1 Sep. 1, 2005

(51) Int. Cl.
*B65D 81/03* (2006.01)

(52) U.S. Cl. ..... 206/522; 383/3; 383/66

(58) Field of Classification Search ..... 383/3, 383/37, 44, 66, 109; 206/521, 522, 591, 206/592; 446/224; 156/290
See application file for complete search history.

(56) References Cited

U.S. PATENT DOCUMENTS 4,917,646 A * 4/1990 Kieves ..... 446/224
5,427,830 A * 6/1995 Pharo ..... 428/35.2
6,283,296 B1 * 9/2001 Newman ..... 206/522
6,629,777 B2 * 10/2003 Tanaka et al. ..... 383/3
2003/0094395 A1 * 5/2003 Peper et al. ..... 206/522

FOREIGN PATENT DOCUMENTS

FR 2067530 A * 7/1971
FR 2291114 A * 7/1976

* cited by examiner

*Primary Examiner*—Mickey Yu
*Assistant Examiner*—Jerrold Johnson
(74) *Attorney, Agent, or Firm*—Apex Juris pllc; Tracy M Heims

(57) ABSTRACT

An air packing bag of plastic for shipping or storing goods is disclosed. The bag includes upper and lower sheets, a valve mechanism including upper and lower films and an intermediate heat-proof member, parallel bladders formed by the upper and the lower sheets, the bladders being perpendicular to the valve mechanism, seals each formed between two adjacent bladders, an air passage formed across the bladders for being in communication therewith, the air passage being adjacent the valve mechanism and having an air valve at one end, and coupling points formed on the upper sheet adjacent the air passage. Pressure inside the inflated bladders pushes both the upper and the lower films to urge against an inner surface of the upper sheet for blocking air from leaving the bladders.

4 Claims, 5 Drawing Sheets

AIR PACKING BAG HAVING FILM-TYPE CHECK VALVES

BACKGROUND OF THE INVENTION

1. Field of the Invention

The present invention relates to packing bags and, more particularly, to an air packing bag having a film-type check valve in each of a plurality of air bladders thereof.

2. Description of Related Art

Conventionally, a plurality of small raised sacs are formed on a sheet of plastic so that an article enclosed in the sheet (i.e., served as packing bag) can be protected by the sacs. This packing bag can prevent the article from being damaged during shipping or storage. However, such small sacs can provide only a limited buffering effect to the article. Thus, the article may be damaged if the sheet is exposed to a significant impact.

Taiwanese Patent Publication No. 363,600 disclosed a packing bag comprising an inner surface, an outer curve surface, and an inflatable air bladder defined by the surfaces. Goods can be stored in the bladder prior to sealing. Such configuration can provide a buffering effect to the goods. Further, Taiwanese Patent Publication No. 128,326 disclosed an air packing sheet of plastic. The sheet is inflated prior to folding into two equal airtight bladders along a central seal for storing the goods therebetween. However, the bladders of both patents tend to puncture easily and leak air, resulting in failure of the buffering. Moreover, valves thereof are complex in construction, resulting in an uneconomic manufacturing cost.

Recently, an air packing bag including a plurality of parallel connected elongated bladders has become available in the market. Although such a packing bag can protect the goods stored therein, a number of drawbacks are found in it since all of the bladders are identical. For example, a seal between any two adjacent bladders may be not completely formed, resulting in a leak (i.e., low production). Further, alignment of seals is difficult, resulting in high manufacturing cost.

Therefore, it is desirable to provide a novel air packing bag having a film-type check valve in each of a plurality of air bladders thereof in order to mitigate and/or obviate the aforementioned problems.

SUMMARY OF THE INVENTION

An object of the present invention is to provide an air packing bag of plastic, comprising an upper sheet; a lower sheet; a valve mechanism formed within the upper and the lower sheets and including an upper film, a lower film, and an intermediate heat-proof member; a plurality of parallel bladders formed within the upper and the lower sheets, the bladders being perpendicular to the valve mechanism; a plurality of seals each formed between two adjacent bladders by hot pressing; an air passage formed across the bladders for being in communication therewith, the air passage being adjacent the valve mechanism and having an air valve at one end; and a plurality of coupling points formed on a surface of the upper sheet adjacent the air passage, wherein pressure inside the inflated bladders pushes both the upper and the lower films to urge against an inner surface of the upper sheet for blocking fluid from leaving the bladders. By utilizing the present invention, a number of advantages are obtained. For example, the bladders having different sizes can meet the requirements of applications. Further, the seals are longitudinally formed on the air packing bag in a single manufacturing process, resulting in a reduction in the manufacturing cost and high yield. To the contrary, the prior art has to consider the spacing between two seals for alignment purpose, resulting in a low production.

In one aspect of the present invention, the bladders are not identical in size and the bladders can be elongated, prismatic, cubic, or polygonal.

In another aspect of the present invention the coupling points are coupled to the upper sheet, the upper film, and the lower film for forming a check valve of each bladder.

In still another aspect of the present invention a fluid entrance or escape path of one bladder is independent from that of the other bladders. Thus, one punctured bladder will not affect the hermetic feature of the other remaining bladders.

Other objects, advantages, and novel features of the present invention will become more apparent from the detailed description when taken in conjunction with the accompanying drawings.

DETAILED DESCRIPTION OF THE PREFERRED EMBODIMENT

Figure 1:
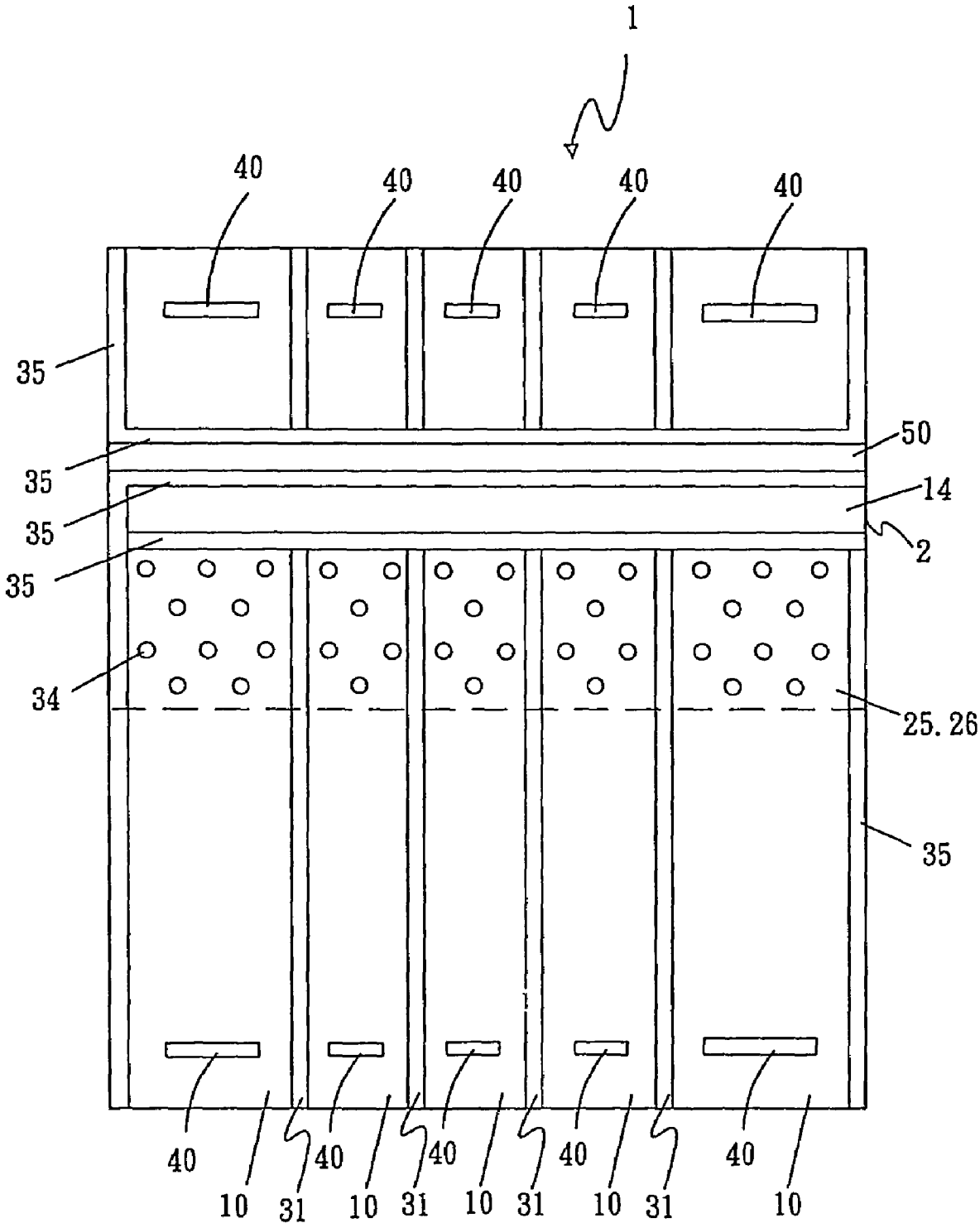
FIG. 1 is a top plan view of a first preferred embodiment of air packing bag according to the present invention, where the bag is not inflated.

With reference to FIG. 1, there is shown a rectangular air packing bag 1 made of plastic in accordance with a first preferred embodiment of the present invention comprising a plurality of parallel bladders 10 in which a seal 31 is formed between two adjacent bladders 10 by hot pressing. The seals 31 are not equally spaced apart. That is, one bladder 10 may have a size different from the other bladder 10 depending on applications. A transverse air passage 14 is formed across the bladders 10. The air passage 14 has a closed end and an open end (i.e., air valve) 2. The air passage 14 is in communication with the bladders 10. Hence, air (or any inert gas) can be forced through the air valve 2 prior to entering the bladders 10 via the air passage 14.

Figure 2:
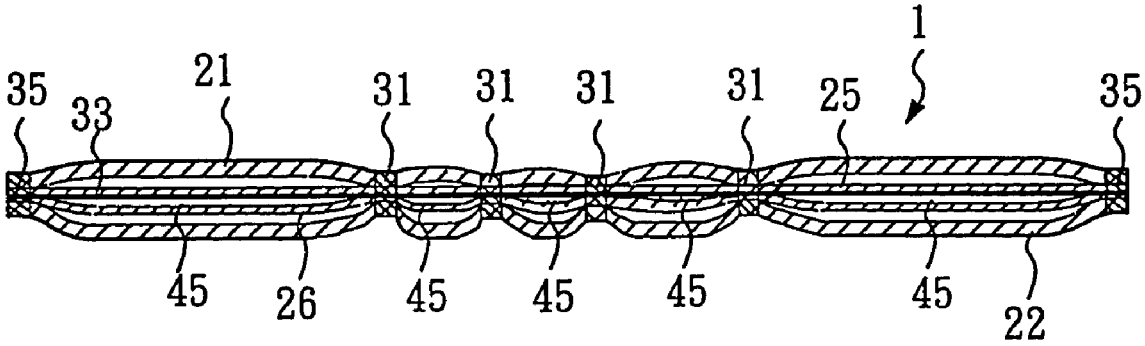
FIG. 2 is a sectional view of the bag.

With reference to FIG. 2, the bag 1 further comprises an upper sheet 21, a lower sheet 22, and a transverse valve mechanism formed by an upper film 25 and a lower film 26 inside the bag 1 and adjacent the air passage 14. Second seals 35 are formed at all sides except top and bottom ends and are formed on both sides of each of the air passage 14 and an opening 50 of the bag 1 by hot pressing. Further, a transverse heat-proof member 33 is formed between the upper and the lower films 25 and 26 and is located in the air passage 14. The provision of the heat-proof member 33 is to prevent the upper and the lower films 25 and 26 and a plurality of inlets 45 each formed in the bladder 10 from being adhered together during hot pressing. As an end, air inflation can be facilitated.

With reference to FIG. 1 again, a plurality of coupling points 34 are formed on a portion of the bladders 10 adjacent the air passage 14 (i.e., on the surface of the upper sheet 21). The coupling point 34 can be rounded or of any other shape. The coupling points 34 are formed for coupling the upper sheet 21, the upper film 25, and the lower film 26 together. A folding line 40 is formed adjacent either end of each bladder 10. The provision of the folding lines 40 is to bend the bladders 10 when the bag 1 is inflated.

Figure 4:
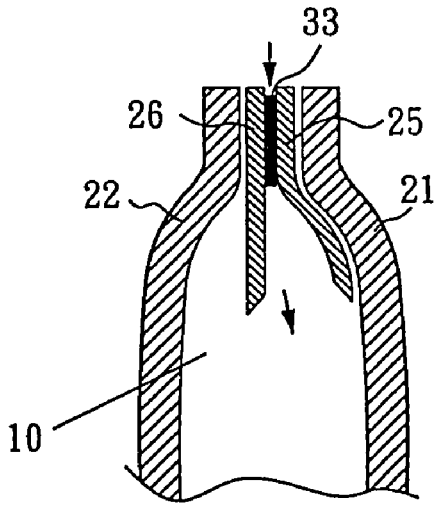
FIG. 4 is a sectional view showing the bladder during inflation.
Figure 5:
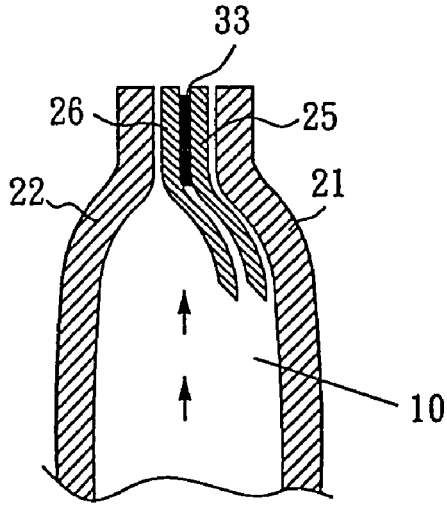
FIG. 5 is a view similar to FIG. 4, the bladder being inflated and the film-type valve mechanism being closed for blocking air passage.
Figure 3:
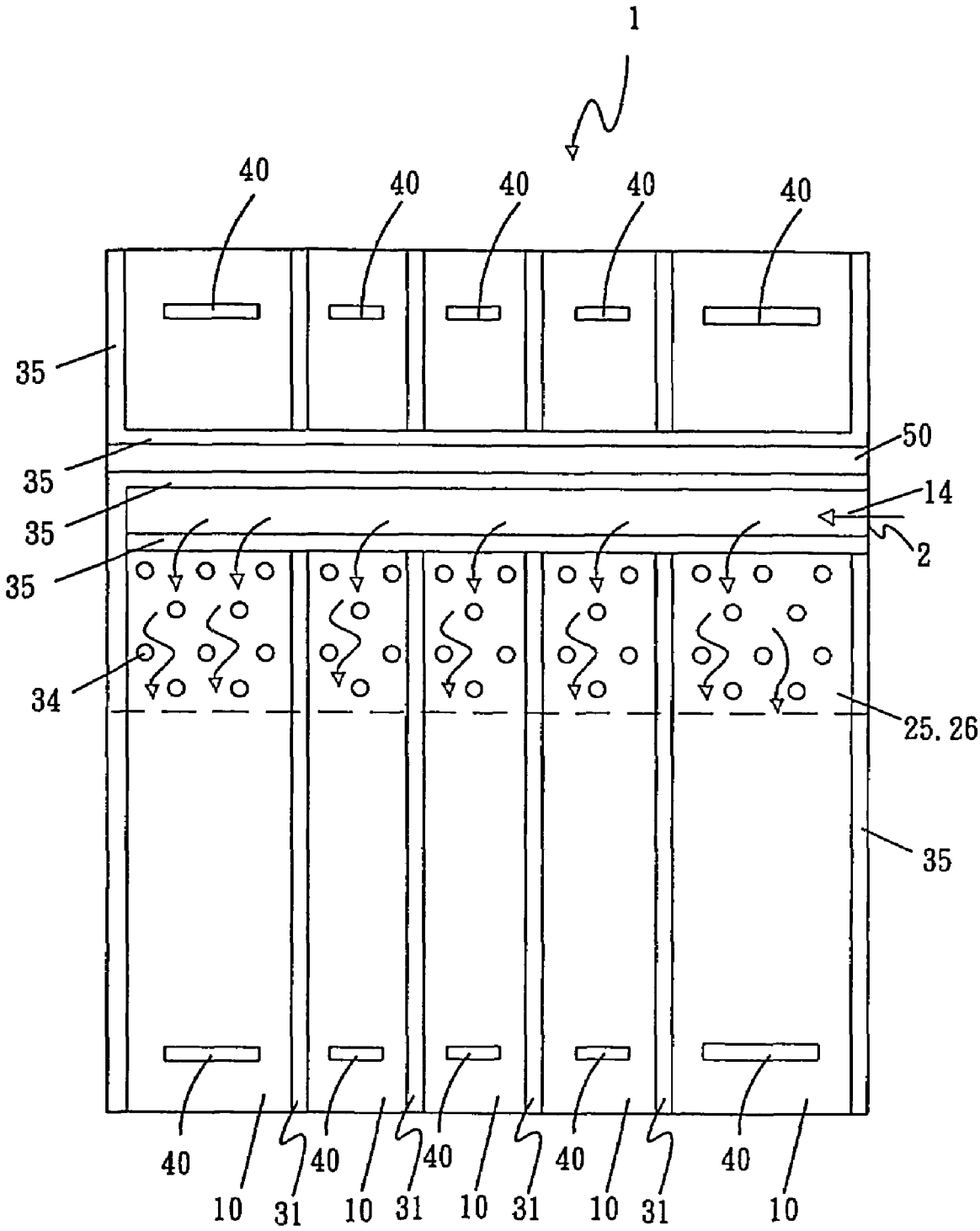
FIG. 3 is a view similar to FIG. 1 for the illustration of pumping air into the bag.

With reference to FIG. 3, air from the air passage 14 enters the bladders 10 via a plurality of paths (as indicated by arrows) formed by the coupling points 34. With reference to FIGS. 4 and 5, the bladder 10 is blown full as air enters. The high pressure air pushes both the upper and the lower films 25 and 26 to urge against an inner surface of the upper sheet 21. As stated above, the upper sheet 21, the upper film 25, and the lower film 26 are coupled together by the coupling points 34, thus both the upper and the lower films 25 and 26 are pushed toward the upper sheet 21 rather than the lower sheet 22 when pressure acts thereon. As such, the inlet of the bladder 10 is closed. This forms an airtight bladder. At the same time, the coupling points 34 form a check valve in each bladder 10 for enhancing the airtightness.

Figure 6:
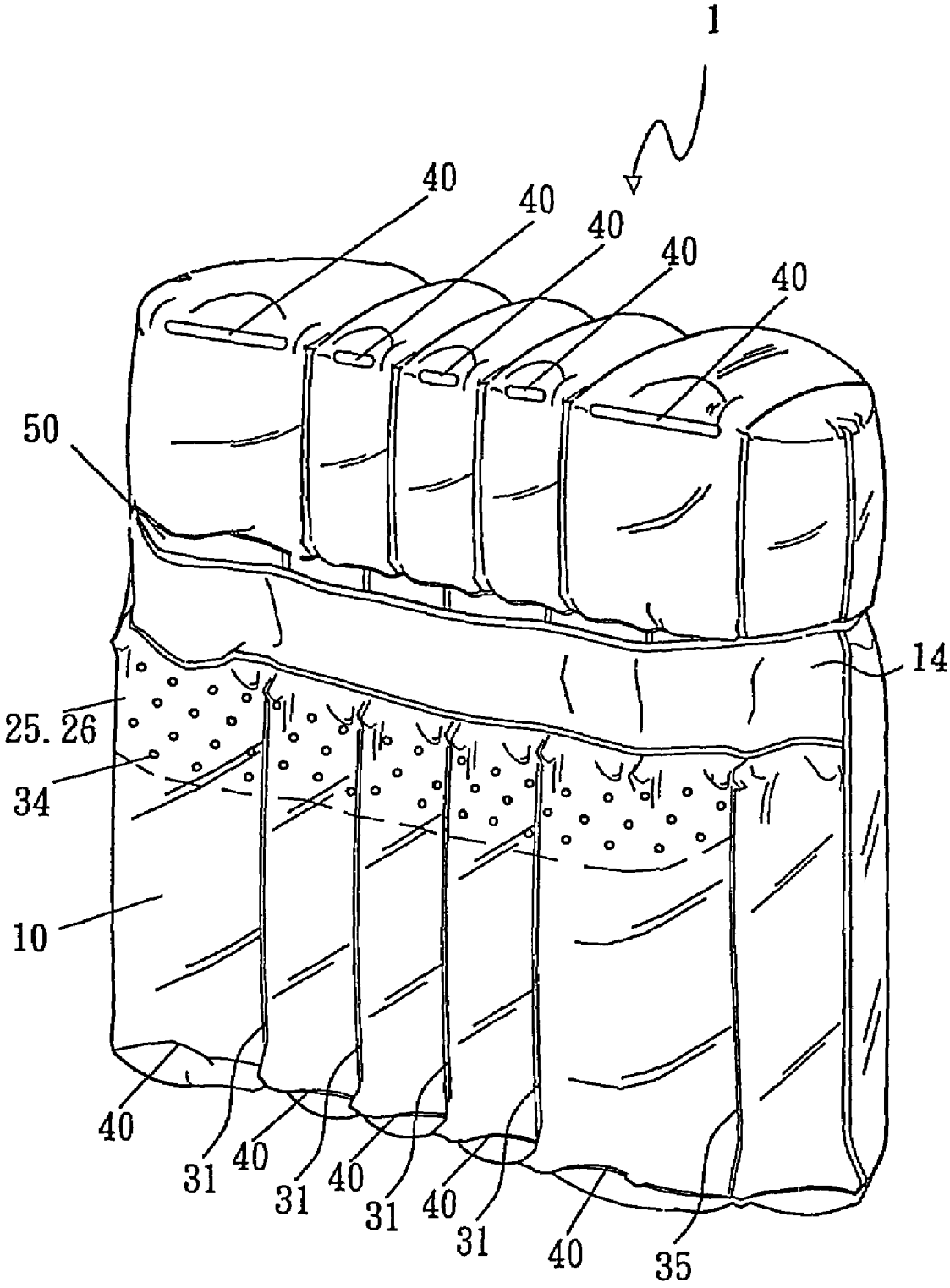
FIG. 6 is a perspective view of the inflated bag.

With reference to FIG. 6, there is shown an inflated bag 1 with all of the bladders 10 being blown full. Goods can be stored in the bladders 10 through the opening 50. Further, the air passage 14 is still flat (i.e., not inflated) so as to block the passage of the opening 50. As a result, the goods are protected. Note that one punctured bladder 10 will not affect the airtightness of the other remaining bladders 10.

Figure 7:
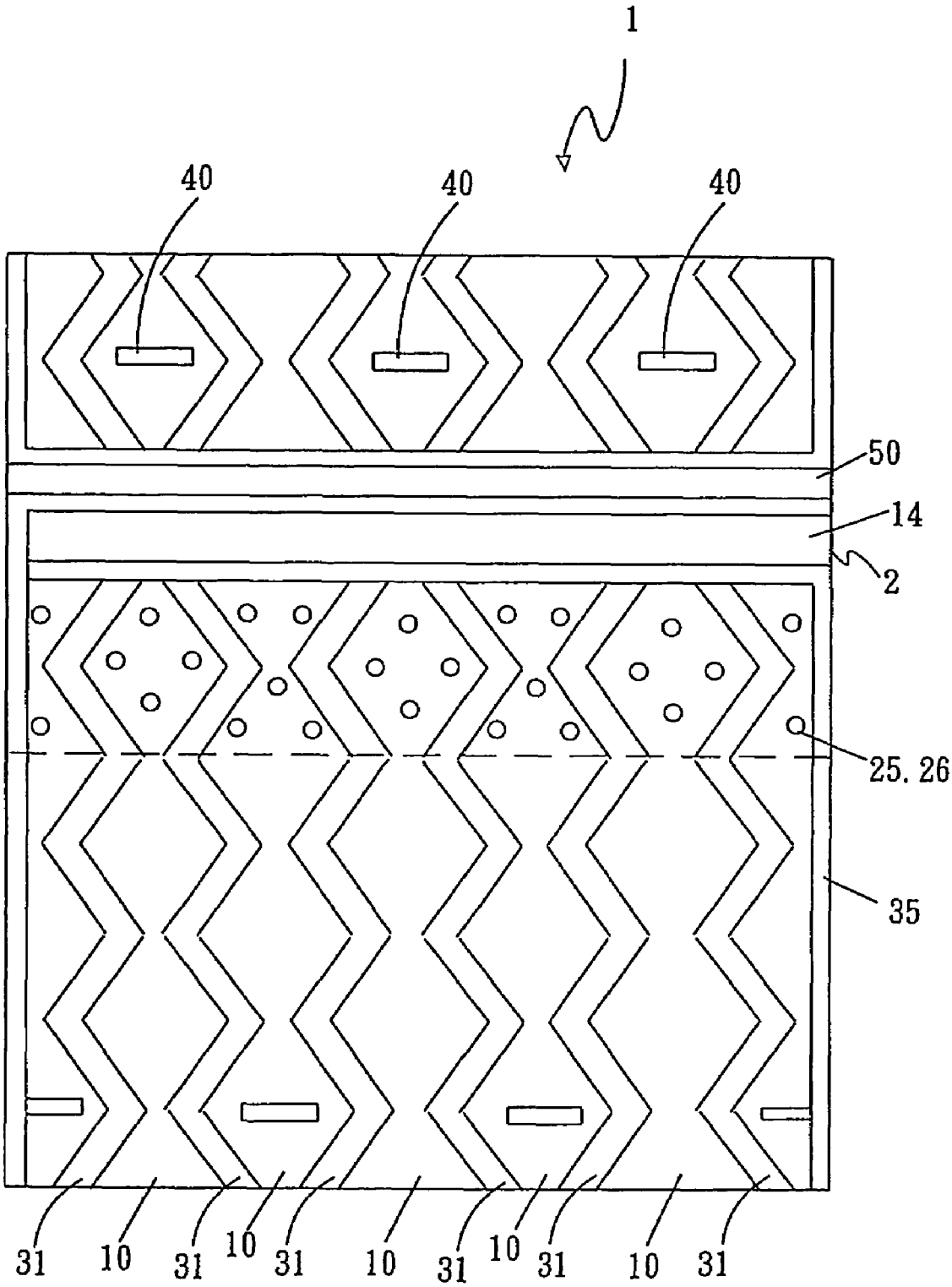
FIG. 7 is a top plan view of a second preferred embodiment of air packing bag according to the present invention, where the bag is not inflated.

With reference to FIG. 7, there is shown a second preferred embodiment of the air packing bag 1 according to the present invention. It is appreciated that the air passage 14 can be provided on a top end or any other position of the bag 1 in other embodiments. Also, the inflated bladders 10 can have other shapes (e.g., prismatic (as shown), cubic, round, polygonal body, etc.). Accordingly, the shapes of the seals 31 are changed.

In brief, the present invention provides an air packing bag including a plurality of independent bladders which are able to protect the goods stored therein when inflated. Also, the coupling points serve as a check valve in each bladder. The present invention is advantageous over the prior art which forms an air passage as a check valve in each bladder by hot pressing. Moreover, the seals are longitudinally formed on the air packing bag of the present invention in a single manufacturing process. To the contrary, the prior art has to consider the spacing between two seals for alignment purpose, resulting in a low production.

Although the present invention has been explained in relation to its preferred embodiment, it is to be understood that many other possible modifications and variations can be made without departing from the scope of the present invention as hereinafter claimed.

What is claimed is:

1. An air packing bag comprising:

an upper sheet;

a lower sheet;

a plurality of seals formed on the upper and lower sheets defining a plurality of bladders;

an air passage formed across the plurality of bladders;

a film check valve disposed in each bladder, the film check valve in communication with the air passage, the film check valve comprising:

a lower film located between the upper sheet and the lower sheet;

an upper film located between the upper sheet and the lower film;

an intermediate heat-proof member separating the upper film and the lower film;

a plurality of spaced apart coupling points disposed within the bladder and further being spaced from the plurality of seals defining that bladder, the coupling points coupling the upper and lower films to each other at each coupling point location, the coupling points further coupling the upper and lower films to the upper sheet at each coupling point location such that when the bladder is under inflation the lower film and the upper film are urged against the upper sheet thus blocking air or other inert gas from leaving the bladder.

2. The air packing bag according to claim 1 wherein each of the plurality of bladders has an independent air inlet communicating with the air passage.

3. The air packing bag according to claim 1 wherein the plurality of seals are unevenly spaced.

4. The air packing bag according to claim 1 wherein the upper sheet, the lower sheet, the lower film and the upper film are made of plastic.

* * * * *